United States Patent [19]

Foos

[11] Patent Number: 4,892,220

[45] Date of Patent: Jan. 9, 1990

[54] CONTAINER/DISPENSER FOR WET WIPES AND THE LIKE

[75] Inventor: Douglas E. Foos, Barrington, Ill.

[73] Assignee: Plastofilm Industries, Inc., Wheaton, Ill.

[21] Appl. No.: 373,511

[22] Filed: Jun. 30, 1989

[51] Int. Cl.[4] ..... B65D 43/14

[52] U.S. Cl. ..... 220/339; 220/284; 229/160.2; 229/2.5 R; 206/815

[58] Field of Search ..... 220/4 B, 284, 285, 286, 220/337; 229/2.5 R, 160.2; 206/470, 551, 815

[56] References Cited

U.S. PATENT DOCUMENTS

| | | | |
|---|---|---|---|
| 3,338,465 | 8/1967 | Bard | 220/284 |
| 3,620,403 | 11/1971 | Kump | 206/551 |
| 3,651,983 | 3/1972 | Haugen | 206/815 |
| 3,786,982 | 1/1974 | Rakes et al. | 229/2.5 R |
| 3,938,726 | 2/1976 | Holden, Jr. et al. | 229/2.5 R |
| 4,183,446 | 1/1980 | Davis | 220/4 B |
| 4,244,470 | 1/1981 | Burnham | 229/2.5 R |
| 4,494,650 | 1/1985 | Cullen | 229/2.5 R |
| 4,535,889 | 8/1985 | Terauds | 229/2.5 R |
| 4,753,351 | 6/1988 | Guillin | 229/160.2 |
| 4,753,366 | 6/1988 | Ritter | 229/2.5 R |

*Primary Examiner*—David T. Fidei

*Attorney, Agent, or Firm*—Lee, Mann, Smith, McWilliams & Sweeney

[57] ABSTRACT

The product of the invention is a thermoformed container for wet wipes or the like having a hinged cover that is releaseably secured to the container when it is closed. The container can be opened with one hand by inserting the thumb and index finger in adjoining recesses formed by arcuate formations in front portions of the cover and container body and camming the cover upwardly by pressing the inserted finger and thumb toward each other.

4 Claims, 1 Drawing Sheet

Fig. 1.
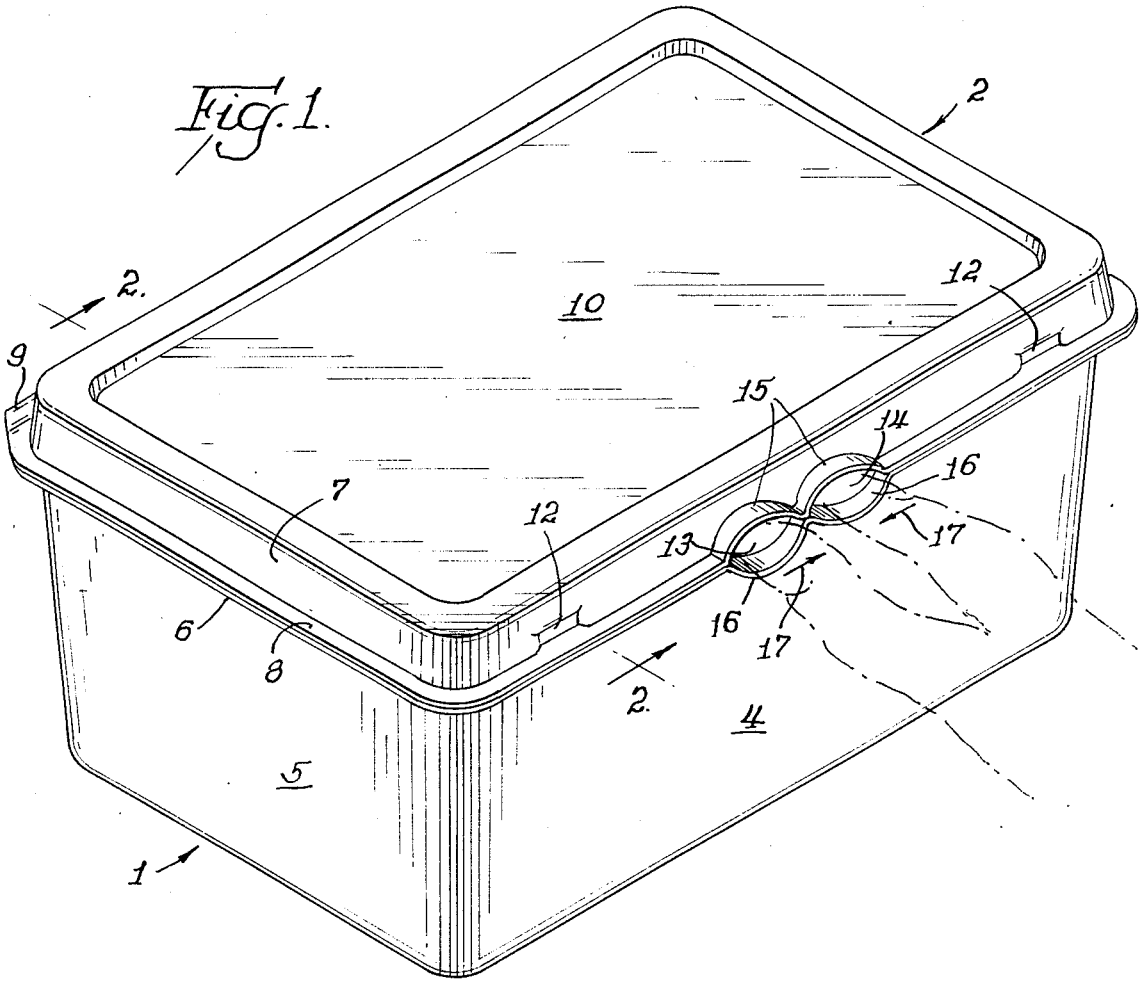
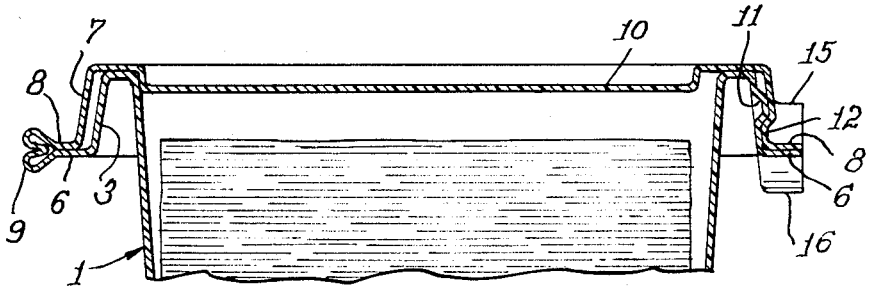
Fig. 2.
Fig. 3.
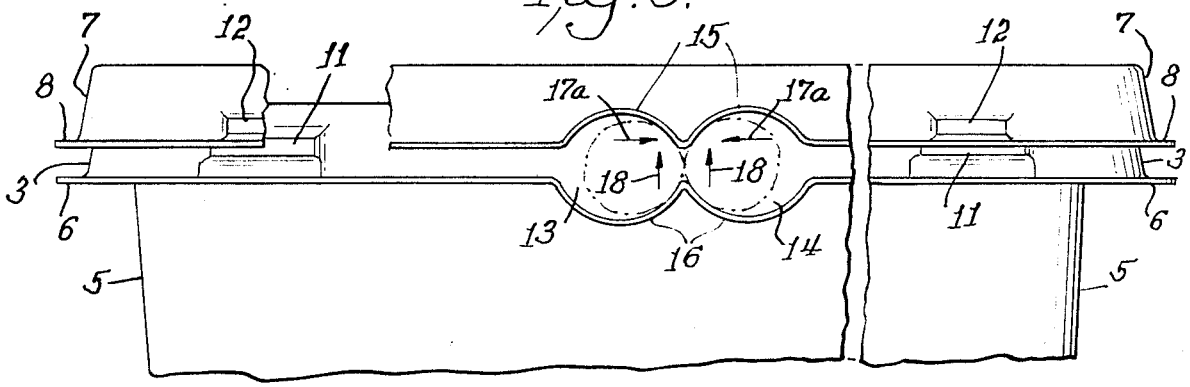

CONTAINER/DISPENSER FOR WET WIPES AND THE LIKE

This invention relates to the packaging of liquid impregnated small disposable paper or other absorbent sheets generally known as "wet wipes". The liquid is suitable for use on the tender skin of babies. They are usually supplied in a stack of usually folded sheets, the wet stack being placed in a container having a hinged lid permitting the removal of the top wet wipe as needed and designed to be closed sufficiently to minimize the evaporation of the liquid and the consequent drying out of the wet wipes.

The special object of this invention is to provide a container for wet wipes that may be opened for withdrawal of a wet wipe by the mother or other person with only one hand, leaving the other hand and arm to hold the baby. As will be seen, the novel features of the invention may also be used on packages other than for wet wipes.

BRIEF DESCRIPTION OF THE DRAWING

An exemplary embodiment of the invention is illustrated in the accompanying drawing wherein:

FIG. 1 is a perspective view of a wet wipes container/dispenser showing the top, front and left side thereof;

FIG. 2 is a cross-sectional view of the container/dispenser taken at the line 2—2 of FIG. 1, and, FIG. 3 is a front view of the container/dispenser diagrammatically showing the forces which have already partially opened the container.

DESCRIPTION OF MODES BEST EMBODYING THE INVENTION

Because the container/dispenser of the invention is specially designed to be opened with one hand, an example of its highest and best use is as a container for wet wipes for babies. Accordingly, although the novel latching and opening structure is also usable on containers for other products, a container/dispenser for wet wipes is illustrated in the drawing and herein described.

The container may be efficiently and inexpensively produced by thermoforming a suitable plastic film which may be transparent or opaque. It comprises a rectangular body 1 having an open top which may be closed by a cover 2. A skirt flange 3 surrounds the top portion of the side and end walls 4 and 5 of body 1 and a horizontal flange 6 extends outwardly from the bottom edge of skirt flange 3. Cover 2 is similarly provided with a skirt flange 7 and horizontal flange 8 to generally mate with the top flange structure of the base of the container. A dead fold living hinge 9 extends along the edges of flanges 6 and 8 integrally therewith along the back of the container. The central portion 10 of cover 2 is depressed to seat within the open top of base 1 as shown in FIG. 2.

The container thus described may be closed as shown in FIGS. 1 and 2 and may be opened by lifting the cover and swinging it up and around hinge 9. A pair of interlocking latch notches 11 and 12 are provided in flanges 3 and 7, respectively, at the front of the container for holding the cover in normally closed position.

Means are provided for easily grasping and lifting the cover from the body upwardly about the hinge. In accordance with the invention, these means are operable by one hand and comprise adjoining recesses 13 and 14 (FIG. 3) formed by adjoining arcuate configurations 15 in the front portion of the flange 8 of cover 2 and similar arcuate configurations 16 in the front portion of flange 6. As is indicated in FIG. 1, the recesses 13 and 14 are sufficiently large to admit the ends of two fingers or the thumb and index finger of one hand, shown in dotted lines, to perform the unlatching and raising of the cover of the container. While the upward force applied to the cover flange to lift the cover from the base may be applied by a slight rotary motion applying upward pressure to flange 8 at 15 and downward pressure to flange 6 at 16, the most convenient and effective approach is to merely press the two fingers or thumb and index finger together as indicated by arrows 17 in FIG. 1 to apply forces as indicated by arrows 17*a* (FIG. 3). The proximate curved portions of the adjoining configurations 15 of flange 8 provide cam surfaces which result in the application of upward forces as indicated by arrows 18 to lift the cover for disengagement of latching notches 11 and 12 so that the cover may be raised and the container thus opened. It will be noted that this camming operation does not tend to move the container itself, rendering unnecessary physically holding the container in position as it is being opened.

After a wet wipe has been removed from the container the cover may be returned to closed position by the same hand that released and raised it.

ACHIEVEMENT

By very simple means formed in the one-piece preform which constitutes the container/dispenser, it is possible by virtue of the instant invention for a mother to obtain a wet wipe from a container of the same while holding her baby with one arm. The container/dispenser is opened with the other hand to make it possible to withdraw a wet wipe from the supply.

I claim:

1. In a thermoformed plastic container/dispenser for wet wipes and the like comprising a rectangular body having an open top, a cover hingedly connected to said body along the top portion of one side of said body and shaped and dimensioned to cover and close the top of said body, horizontal flanges extending outwardly from and along the forward edge portions of at least the fronts of said cover and of said body and engaging each other when said container is closed, and means for releasably holding said cover in position upon said body when said container is closed, the improvement which comprises means operable with one hand for opening said container/dispenser, said means comprising a pair of adjoining arcuate formations opening downwardly in said flange extending from said cover and a second pair of adjoining arcuate formations opening outwardly in said flange extending from said body, said pairs of formations being mutually opposite each other to define adjoining recesses adapted respectively to receive the thumb and finger of a hand whereby to exert upwardly directed force upon said flange extending from said cover to lift and disengage the same from said body in opening said container/dispenser.

2. A container/dispenser in accordance with claim 1 wherein the proximate portions of said first-mentioned arcuate formations form cam surfaces which cause upward movement of said cover as the thumb and index finger of the person operating said means for opening said container/dispenser are moved toward each other.

3. A container/dispenser in accordance with claim 1 wherein said means for releasably holding said cover closed comprises skirt flanges depending from the front portion of said cover and the top portion of said body, respectively, and interlocking latch notches provided in said skirt flanges respectively approximately equidistant from said means for opening said container/dispenser.

4. A container/dispenser in accordance with claim 3 wherein said means for opening said container/dispenser is located at approximately the midpoint between the ends of said horizontal flanges.

* * * * *